US005105127A

United States Patent [19]

Lavaud et al.

[11] Patent Number: 5,105,127

[45] Date of Patent: Apr. 14, 1992

[54] DIMMING METHOD AND DEVICE FOR FLUORESCENT LAMPS USED FOR BACKLIGHTING OF LIQUID CRYSTAL SCREENS

[75] Inventors: Georges Lavaud, Wissous; Jean P. Bouron, Ville D'Avray, both of France

[73] Assignee: Thomson-CSF, Puteaux, France

[21] Appl. No.: 541,766

[22] Filed: Jun. 21, 1990

[30] Foreign Application Priority Data

Jun. 30, 1989 [FR] France ..... 89 08807

[51] Int. Cl.[5] ..... G05F 1/00

[52] U.S. Cl. ..... 315/291; 315/307; 315/DIG. 4

[58] Field of Search ..... 315/291, 307, DIG. 4; 340/784; 350/345

[56] References Cited

U.S. PATENT DOCUMENTS

| | | | |
|---|---|---|---|
| 4,219,760 | 8/1980 | Ferro | 315/248 |
| 4,682,083 | 7/1987 | Alley | 315/307 |
| 4,891,828 | 1/1990 | Kawazoe | 315/291 |
| 5,001,386 | 3/1991 | Sullivan et al. | 315/219 |

FOREIGN PATENT DOCUMENTS

| | | |
|---|---|---|
| 0104264 | 4/1984 | European Pat. Off. . |
| 0152026 | 8/1985 | European Pat. Off. . |
| 3048531 | 9/1981 | Fed. Rep. of Germany . |
| 2584845 | 1/1987 | France . |
| 2179510 | 3/1987 | United Kingdom . |

*Primary Examiner*—Eugene R. LaRoche
*Assistant Examiner*—R. Ratliff
*Attorney, Agent, or Firm*—Oblon, Spivak, McClelland, Maier & Neustadt

[57] ABSTRACT

A dimming device, with a brightness dimming ratio of 1 to 1000, for a fluorescent lamp used for the backlighting of a liquid crystal screen comprises a periodic signal generator for delivering rectangular pulses with an adjustable duty cycle. The pulses are synchronized with the image synchronizing signal of the liquid crystal screen. An alternating voltage generator provides power to the lamp only during the pulses. The decrease in tube efficiency for very short pulses allows the required dimming intensity to be achieved without image flickering.

8 Claims, 2 Drawing Sheets

DIMMING METHOD AND DEVICE FOR FLUORESCENT LAMPS USED FOR BACKLIGHTING OF LIQUID CRYSTAL SCREENS

BACKGROUND OF THE INVENTION

This invention relates to a dimming method and device for fluorescent lamps to be used in a backlighting system for liquid crystal visual displays.

Liquid crystal screens, more particularly those used for color visual display on instrument panels in airplanes and helicopters, are equipped with backlighting systems which provide a high level of brightness making them comfortably visible even with strong ambient light. This brightness must be variable allowing it to be adapted to the various intensities of ambient light, and this brightness must also be adaptable to day-night ambient variations. Such variations imply a light dimming ratio of 1000:1, which for fluorescent lamps corresponds to a brightness intensity of a few $Cd/m^2$ for minimum brightness and approximately 15,000 $Cd/m^2$ for maximum brightness.

It is to be noted that the light source uses fluorescent lamps due to their high energy efficiency and to their colorimetry which is well-adapted to liquid crystal screens.

To obtain an optimal brightness level with these lamps, the power supply voltage which is applied between their two electrodes is a high alternating voltage, generally between 300 and 500 volts, at a frequency of several tens of kilohertz.

As is well-known in the art, it is possible to vary the brightness of a fluorescent lamp by varying the amplitude of the power voltage and consequently, the current traversing the lamp. This method is only capable of producing a brightness dimming ratio of 10:1, which is insufficient for the above-mentioned application. Moreover, the fact that the triggering voltage of a fluorescent lamp is dependent on the temperature, more precisely, that this voltage increases as temperature falls, implies that this brightness control method does not allow operation over a wide temperature range, especially when the temperature is below 0° C.

It is generally known that the range of brightness levels can be improved by modulating the frequency of the alternating supply voltage and, more precisely, by using, for example, square waves of frequency varying from tens of hertz to tens of kilohertz. In this case, however, to satisfy the aforementioned conditions of operation, it is necessary to work with frequencies of less than 15 kilohertz in order to produce low brightness levels and at these frequencies sound vibrations may result. Finally, at a very low brightness level there appears a flickering due to stroboscopic effect between the intermittent ignition of lamps and the refreshing of the image of which the frequency is between 50 and 60 hertz. This results in a bright horizontal bar on the screen which is absolutely unacceptable for pilot control displays.

As is also well-known in the art, the brightness of a fluorescent lamp can be varied by applying a square wave voltage with an adjustable duty cycle width. However, there exist problems with respect to stroboscopic effect in this method too.

SUMMARY OF THE INVENTION

The purpose of the present invention is to resolve such problems. The solution is provided by a pulsed supply voltage to a fluorescent lamp used for the backlighting of a liquid crystal screen. The width of the bursts can be altered according to the required level of brightness. The start of the bursts is synchronized with the "image synchronizing" signal of the liquid crystal screen.

According to the present invention, there is provided a dimming method for a fluorescent lamp used for the backlighting of a liquid crystal screen with an image synchronizing signal associated to the screen, the method comprising the steps of applying an alternating supply voltage have a set frequency to the lamp, switching the alternating supply voltage by means of rectangular periodic signals having adjustable duty cycles which depend on the luminous intensity required for the lamp and synchronizing the rectangular signals with a signal corresponding to the image synchronizing signal divided in frequency by a whole number, n, superior to 0.

According to the present invention there is further provided a dimming device for fluorescent lamp used for the backlighting of a liquid crystal screen with an image synchronizing signal associated to the screen, comprising: a switching generator producing switching signals at a fixed frequency in form of rectangular periodic signals made of pulses with adjustable width; synchronizing means for synchronizing the switching signal with a signal corresponding to the image synchronizing signal divided by an integer greater than 0; an alternating voltage generator to provide power to the fluorescent lamp; and locking means controlled by the switching signals to allow the voltage generator to function only during the duration of the pulses of the rectangular periodic signals.

BRIEF DESCRIPTION OF THE DRAWINGS

For an improved understanding and illustration of the characteristics of the invention the following diagrams are presented.

DETAILED DESCRIPTION OF THE PREFERRED EMBODIMENTS

Figure 1:
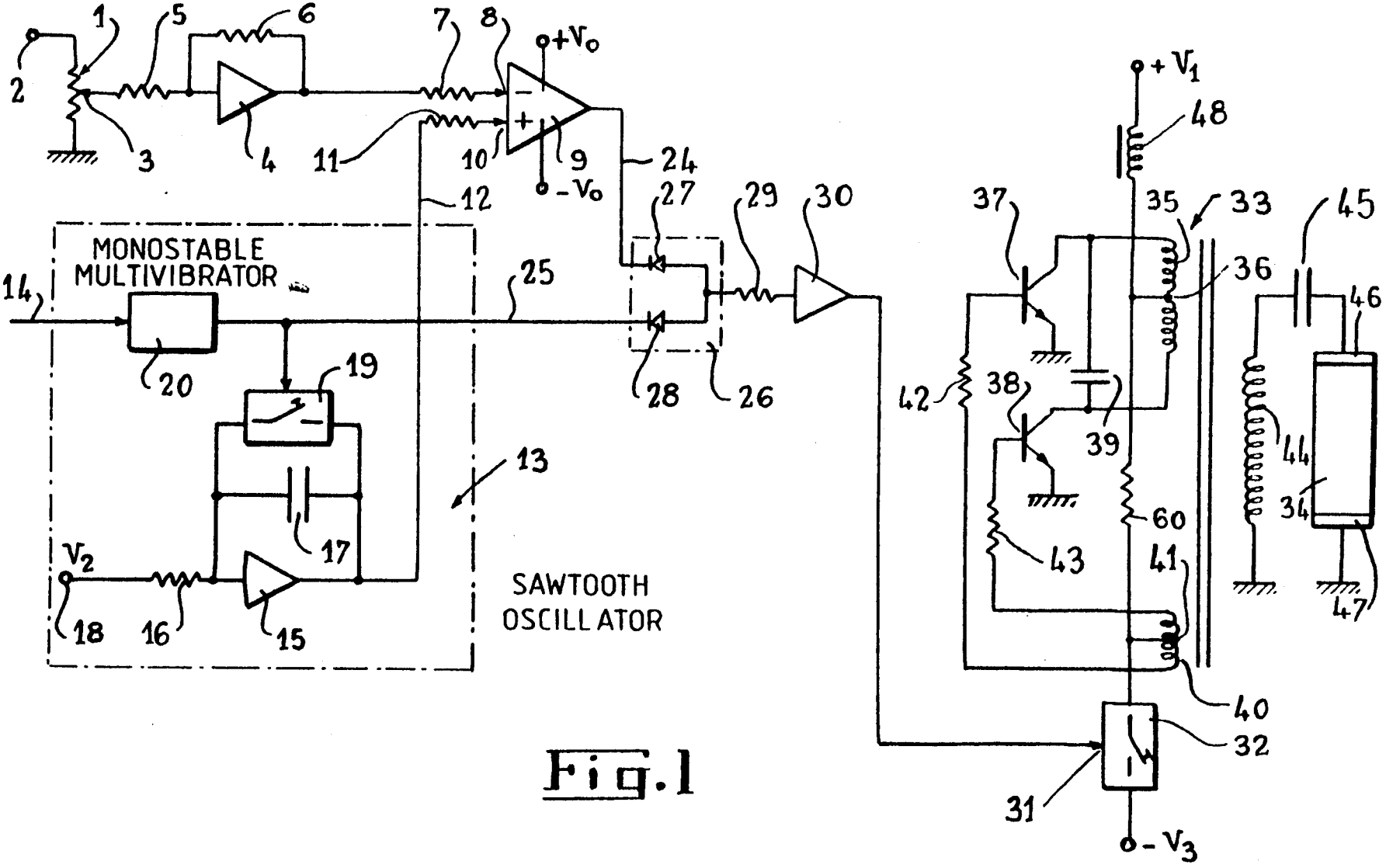
FIG. 1 is a circuit diagram representing a dimming device, according to the invention, for a fluorescent lamp used for the backlighting of a liquid crystal screen.

FIG. 1 illustrates a brightness control potentiometer 1 which receives negative DC supply voltage at a terminal 2. Part of this direct voltage is tapped by a slider 3 of the potentiometer 1, in order to provide a direct voltage, which is adjusted by means of the slider 3, which after amplification by the operational amplifier 4 (combined with a series resistance 5 and a negative feedback resistance 6) is applied via resistance 7 to the input inverter 8 of a voltage comparator 9, which is fed by a DC voltage (+Vo, −Vo).

The non-inverting input 10 of the comparator is connected, via a resistance 11, to the output 12 of a sawtooth oscillator 13, whose signals are synchronized with the image synchronizing pulse signal of a liquid crystal screen; this pulse signal is applied to 14 on the oscillator 13.

This oscillator 13 comprises an operational amplifier 15 mounted as an integrator using a capacitor 17 connecting input and output, and a resistance 16 which connects its input to a terminal 18 to which is applied a reference voltage V2.

Rapid return of sawtooth pulses is provided by means of a rapid CMOS-type analog switch 19 connected in parallel with the capacitor 17 and which is controlled by image synchronizing pulses produced by a monostable multivibrator 20.

Figure 2:
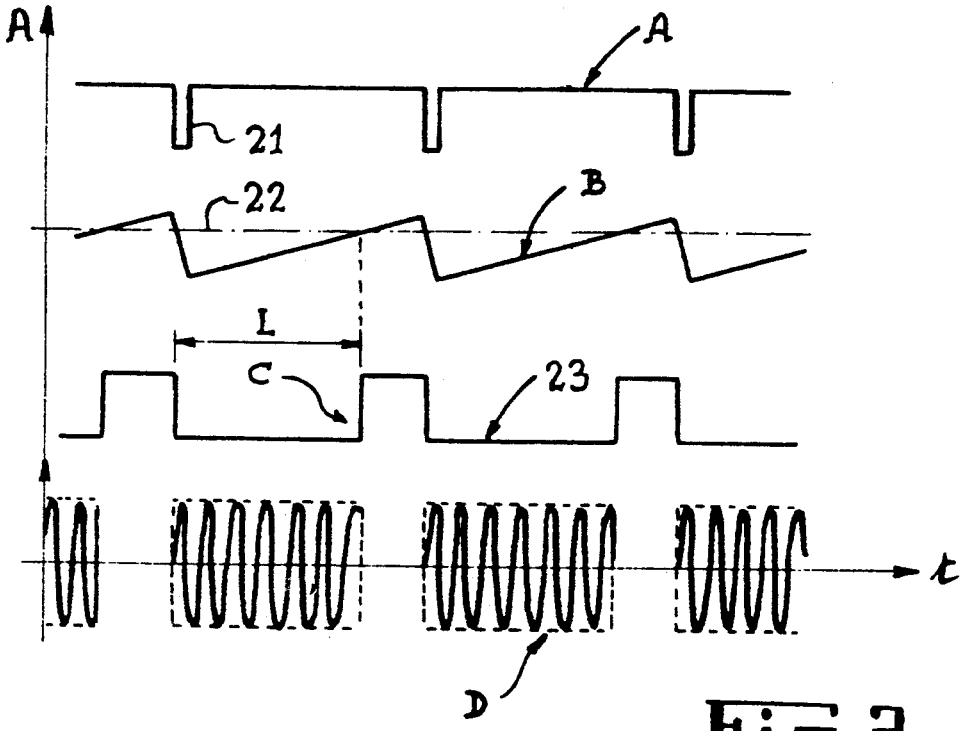
FIG. 2 is a timing diagram to explain the operation of the device illustrated in FIG. 1.

In FIG. 2, a diagram showing curves amplitude (A) versus time (t), the (negative) image synchronizing pulses 21 are represented on the upper curve A, whereas sawtooth pulses at output 12 of oscillator 13 are represented on curve B. The adjustable direct voltage applied to 8 is represented by the broken dash-dot line at 22.

As long as curves B and 22 intersect, the intermittent negative voltage bursts 23, of the duty cycle L, adjustable by means of the slider 3, are generated at output 24 of the comparator 9, the amplitude of these bursts being equal to Vo.

The elements with reference numbers 1 to 20 form an intermittent pulse generator with fixed frequency and an adjustable duty cycle whereby the bursts are synchronized with the image synchronizing pulses 21 of the liquid crystal screen requiring backlighting.

The output 24 of the comparator 9 provides rectangular signals 23 made of pulses and the output 25 of the monostable multivibrator 20 provides pulses 21; these outputs are respectively connected to two diodes 27, 22 of an OR circuit 26; the output of circuit 26 is coupled, via resistance 29, followed by a regenerating amplifier 30, to the control input 31 of a different analog switch 32. This switch 32 is open when a negative pulse 23 or 21 is applied to 31, and it is closed in the opposite case. It acts as a control switch for the high alternating voltage supply oscillator 33 to the fluorescent lamp 34.

The oscillator 33 comprises: a transformer with a main primary winding 35 and a center tap 36, a feedback winding 40 and a center tap 41, and a secondary winding 44, two N-P-N transistors 37, 38, a capacitor 39, three resistances 42, 43, 60 and an induction coil, 48. The emitters of transistors 37, 38 are connected to ground, and their collectors are connected respectively to the two extremities of the primary winding 35, and the bases are connected respectively to the two extremities of the feedback winding 40. The capacitor 39 is situated between the two extremities of the primary winding 35. The secondary high-voltage winding 44 of the transformer has one terminal grounded and another terminal connected, via a ballast capacitor 45, to an electrode 46 of the fluorescent lamp 34; the other electrode, 47, is grounded.

The positive supply voltage +V1 from the oscillator 33 is applied via the induction coil 48, to the center tap 36 and then across the resistance 60, to the center tap 41, while a negative direct control voltage −V3 is applied when the switch 32 is closed, to the center tap 41, then across the resistance 60 to the center tap 36.

Circuit operation in FIG. 1 is the following:

When the slider 3 of the potentiometer 1 is at the upper limit (in FIG. 1), the positive voltage applied to the terminal 8 is maximum, greater than that of the sawtooth B, so that a direct voltage level equal to −Vo is applied to 24.

The voltage applied to the control input 31 of the switch 32 is then continuous, so that the switch 32 remains open permanently and the oscillator 33 operates without interruption, allowing the fluorescent lamp 34 to operate at a level of maximum brightness.

When the slider is progressively moved downwards from this upper limit (approaching ground state), the voltage 22 (FIG. 2) decreases in amplitude and intersects the sawtooth curve B which generates pulses 23, with a duty cycle L, which progressively decrease as the slider 3 approaches ground state, and for which the leading edge is synchronized with that of the pulses 21. The oscillator 33, at this point, operates only during the pulses 23 (curve D in FIG. 2) since during the pulsefree period the switch 32 is closed and the voltage −V3 consequently blocks the oscillator 33.

The brightness level obtained by the lamp 34 is therefore proportional to the duty cycle L of the pulses 23, which depend on the position of the slider 3.

When the slider 3 reaches its lowest limit (ground side), no signals appear at output 24, however, due to the OR circuit 28, pulses 21 are nevertheless applied to the control terminal 31, which causes the oscillator 33 to function while the image synchronizing pulses 21 are present: in this manner a minimum visible brightness level is obtained for the lamp 34.

Figure 3:
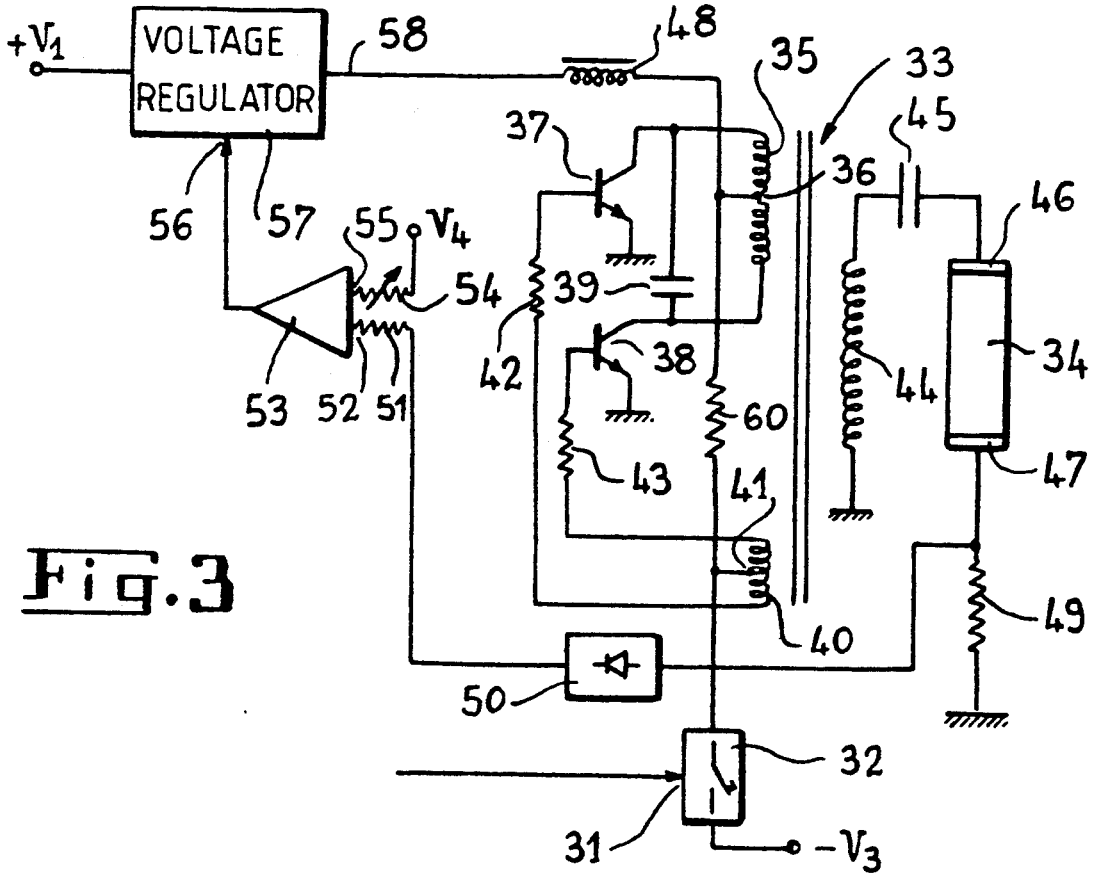
FIG. 3, a partial circuit diagram representing a variant embodiment of the device illustrated in FIG. 1.

The circuit according to FIG. 3 represents another version according to the invention, where the differences with respect to FIG. 1 have been illustrated; this circuit comprises a series resistance 49, or "foot resistance" which is placed between the electrode 47 of the lamp 34 and the ground. The terminal voltage of this resistance 49 is applied, via a rectifier 50 and a series resistance 51, to a first input 52 of a differential amplifier 53. The other input 55 of this differential amplifier 53 receives by means of a reference voltage V4 and an adjustable resistance 54, a direct adjustable voltage.

The output of the differential amplifier 53 is connected to the control input 56 of a voltage regulator 57 which is inserted between the power supply terminal +V1 and the induction coil 48 and which is capable of varying the direct voltage at its output 58 in relation to the control voltage which it receives at input 56.

The part of the device in FIG. 3 corresponding to reference numbers 49 to 57 forms a control loop with the rôle of regulating the current in the resistance 49 and at the same time, in lamp 34, to the value indicated by the reference voltage applied to input 55, this value depending on that of the adjustable resistance 54; thus, it is possible to optimize the value of supply voltage to the lamp 34 with respect to its working point, by minimizing the power loss and by freeing itself of temperature variations.

Moreover, the circuit illustrated in FIG. 3 provides for the triggering of the lamp 34 at a low brightness level or at a very low ambient temperature.

In relation to this subject, it is recalled that the triggering voltage of fluorescent lamps depends on the temperature of the electrodes and of the tube retaining the mercury vapour. At a low level of brightness, the mean current traversing the lamp is very weak and does not heat the lamp. The triggering voltage is therefore higher than when the level of brightness of the lamp is higher. The triggering voltage also increases when the ambient temperature decreases.

Should triggering not occur, due to an insufficient level of brightness or low ambient temperature, no voltage is applied to terminal 52 of the differential amplifier 53, so that the maximum control voltage of regulator 57 is applied to 53, thus increasing the effective supply voltage of the oscillator 33 to over its triggering voltage in such unfavourable conditions, which of course supposes that the voltage +V1 is of sufficient amplitude.

The circuit in FIG. 3 allows for pairing of lamps of low luminosity.

In the case of a lighting system with two or more fluorescent lamps, it is necessary to pair lamps for low brightness levels in order to obtain identical triggering voltages for the lamps, otherwise, one of the lamps is likely to light up and not the other. For this purpose, each lamp has its own circuit according to FIG. 3. This matching is carried out by adjusting the resistances 54 of each circuit so that all the lamps start under the same operational conditions. To achieve the same results it is also possible to adjust the foot resistances 49, but this solution is not as good as there is the risk of increasing losses.

It has been explained previously that a minimum level of brightness is obtained by chopping or modulating the alternating voltage of oscillator 33 by means of pulses which last for a period of time equivalent to the duty cycle of the image synchronizing pulses 21. In fact, these pulses 21 have a duty cycle of about 50 microseconds. Theoretically, to obtain, as required, a variation of luminosity in the fluorescent tube 34 of 1 to 1000, the duty cycle L of pulses 23 must range from 50 microseconds to 1000 times more, in other words 50 milliseconds. Whereas, chopping to 50 milliseconds corresponds to a frequency of 20 hertz, and this would introduce a flicker effect in the image produced on the liquid crystal screen which means that if this theory is purely and simply followed, this device according to the invention will not operate in the required conditions (dimming ratio of 1000:1).

In reality, this is not the case because when the lamp 34 is only allowed to operate during 50 microseconds, it does not have sufficient time to heat up, and the triggering operation in itself is not sufficient to increase the temperature of the lamp. Therefore the brightness efficiency of the lamp when cold is three times inferior to that during continuous or nearly continuous operation, in other words when hot, so that the brightness ratio of 1 to 1000 is finally obtained by passing, for the burst duty cycle L of the sinusoidal alternation of the oscillator 33, from 50 microseconds to around 15 milliseconds, which corresponds to a chopping frequency far higher than those which cause flickering.

The invention is not limited to the embodiments described above. It is thus possible, for example, in the case of automatic regulation of the surrounding light level to replace the brightness control potentiometer 1, with a photodetector which supplies a voltage proportional to the required brightness. In the above example, the beginning of each pulse 23 of the sinusoidal alternation of the oscillator 33 is synchronized with the image synchronizing signal of the liquid crystal screen. In order to extend the operational dynamics of the device it is also possible to synchronize this pulse using the image synchronizing signal divided in frequency by an integer greater than 1. It is obvious that this is only possible if the frequency of the signal divided by this number is not too low, in which case a flickering effect will result. It is also possible, when several fluorescent lamps are required, to use only one switch 32, given that a resistance is inserted in connection between this switch and the center tap 41 of each oscillator related to each lamp.

What is claimed is:

1. A dimming device for fluorescent lamp used for the backlight of liquid crystal screen with an image synchronizing signal applied to the screen, comprising:

a switching generator for producing switching signals, at a fixed frequency, the switching signals being rectangular periodic signals comprising pulses having adjustable widths;

synchronizing means for synchronizing the switching signals with at least some of the image synchronizing signals;

an alternating voltage supply oscillator, connected to a first supply voltage, for applying an alternating voltage to the fluorescent lamp; and blocking means, controlled by the switching signals, to allow the alternating voltage supply oscillator to function only during the duration of the pulses of the rectangular periodic signals, the blocking means comprising switching means for applying a second supply voltage, opposite in polarity to the first supply voltage, to the alternating voltage supply oscillator, the second supply voltage temporarily blocking application of the first supply voltage to the alternating voltage supply oscillator.

2. A dimming device according to claim 1, where, the image synchronizing signal comprising pulses, the switching signals used to obtain a minimum brightness value for the fluorescent lamp are the pulses of the image synchronizing signal.

3. A method for dimming a fluorescent lamp used for the backlighting of a liquid crystal screen to which image synchronizing signals are applied, the method comprising the steps of:

generating switching signals at a fixed frequency, the switching signals being rectangular periodic signals comprising pulses having adjustable widths;

synchronizing the switching signals with at least some of the image synchronizing signals;

applying an alternating voltage, via a transformer connected to a primary supply voltage, to the fluorescent lamp; and selective connecting a blocking supply voltage, opposite in polarity to the primary supply voltage, to the transformer, which temporarily blocks application of the alternating voltage to the lamp, via the transformer, for adjustable periods of time determined by an absence of the pulses of the rectangular periodic signals.

4. A method according to claim 3, wherein the step of selectively connecting is performed in synchronism with integral numbers of the synchronizing signals.

5. A method according to claim 3, wherein the adjustable periods of time have a predetermined maximum duration to assure that the alternating voltage is always applied to the lamp for at least a predetermined minimum period of time.

6. A method according to claim 3, further comprising the step of varying the magnitude of the alternating voltage.

7. A dimming device according to claim 1, further comprising means for varying the magnitude of the alternating voltage.

8. A dimming device according to claim 1, wherein the alternating voltage supply oscillator is a transformer having a primary winding with a center tap and a feedback winding with a further center tap, wherein the first supply voltage is connected to the center tap of the primary winding and wherein the switching means selectively applies the second supply voltage to the feedback winding to block operation of the alternating voltage supply oscillator.

* * * * *